US007995948B2

(12) United States Patent
Yano et al.

(10) Patent No.: US 7,995,948 B2
(45) Date of Patent: Aug. 9, 2011

(54) IMAGE FORMING DEVICE HAVING SIDE COVER WITH INCLINED SURFACE

(75) Inventors: Hidetoshi Yano, Aichi (JP); Sachiko Yano, legal representative, Tokai (JP); Keiichiro Egami, Aichi (JP); Yusuke Nakata, Aichi (JP); Kayo Hasui, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 387 days.

(21) Appl. No.: 12/241,283

(22) Filed: Sep. 30, 2008

(65) Prior Publication Data

US 2009/0174297 A1 Jul. 9, 2009

(30) Foreign Application Priority Data

Oct. 2, 2007 (JP) ..... 2007-258784

(51) Int. Cl.
*G03G 15/00* (2006.01)

(52) U.S. Cl. ..... 399/107; 399/81; 399/405

(58) Field of Classification Search ..... 399/107, 399/405, 81
See application file for complete search history.

(56) References Cited

U.S. PATENT DOCUMENTS

| | | | | |
|---|---|---|---|---|
| 5,978,626 | A | 11/1999 | Nagamine et al. | |
| 7,392,004 | B2 * | 6/2008 | Sato et al. | 399/328 |
| 2005/0012766 | A1 * | 1/2005 | Fukano et al. | 347/7 |
| 2005/0195449 | A1 * | 9/2005 | Hattori et al. | 358/474 |
| 2006/0018693 | A1 * | 1/2006 | Nobe et al. | 399/405 |
| 2006/0246866 | A1 * | 11/2006 | Nakagawa et al. | 455/301 |
| 2007/0165094 | A1 * | 7/2007 | Matsumura et al. | 347/223 |
| 2009/0010697 | A1 * | 1/2009 | Nishimura et al. | 399/405 |
| 2009/0169249 | A1 * | 7/2009 | Watanabe et al. | 399/114 |

FOREIGN PATENT DOCUMENTS

JP 11-153893 A 6/1999

OTHER PUBLICATIONS

User Manual of Oki Printer Model# C5400/C5400n.*

* cited by examiner

*Primary Examiner* — David M Gray
*Assistant Examiner* — G. M. Hyder
(74) *Attorney, Agent, or Firm* — Banner & Witcoff, Ltd

(57) ABSTRACT

An image forming device includes a device body, a side cover fixed to the device body to cover a side face of the device body, a top cover attached swingably to the device body to cover an upper face of the device body, the top cover and the side cover defining a mating portion as a boundary region therebetween, a plane portion formed in a first one of the top cover and the side cover, and an inclined portion formed at a side of the first one in the mating portion, the inclined portion including an inclined surface configured to be inclined with respect to the plane portion, the inclined surface extending toward a back surface side of a second one of the top cover and the side cover.

14 Claims, 10 Drawing Sheets

IMAGE FORMING DEVICE HAVING SIDE COVER WITH INCLINED SURFACE

CROSS-REFERENCE TO RELATED APPLICATION

This application claims priority under 35 U.S.C. §119 from Japanese Patent Application No. 2007-258784 filed on Oct. 2, 2007. The entire subject matter of the application is incorporated herein by reference.

BACKGROUND

1. Technical Field

The following description relates to one or more image forming devices.

2. Related Art

In an image forming device disclosed in Japanese Patent Provisional Publication No. HEI11-153893, a top cover configured to cover an upper face of a device main body is attached swingably to the device main body.

SUMMARY

Aspects of the present invention are advantageous to provide one or more improved configurations of an image forming device with a top cover thereof attached swingably to a device main body which configurations are different from a known configuration of such an image forming device.

According to aspects of the present invention, provided is an image forming device, which includes a device body, a side cover fixed to the device body to cover a side face of the device body, a top cover attached swingably to the device body to cover an upper face of the device body, the top cover and the side cover defining a mating portion as a boundary region therebetween, a plane portion formed in a first one of the top cover and the side cover, and an inclined portion formed at a side of the first one in the mating portion, the inclined portion including an inclined surface configured to be inclined with respect to the plane portion, the inclined surface extending toward a back surface side of a second one of the top cover and the side cover.

In some aspects of the present invention, the inclined portion is provided at a side of either the side cover or the top cover in the mating portion. Therefore, the contour of the mating portion is obscurer than a known configuration without the inclined portion. Accordingly, even though dimensions of the mating portion between the side cover and the top cover vary by relatively significant amounts, it is possible to prevent the image forming device from detracting from its appearance. Thus, in some aspects, such an improved configuration different from the known configuration can be provided.

According to aspects of the present invention, further provided is an image forming device configured to form an image on a sheet. The image forming device includes a top cover swingably attached to an upper rear end of the device body, the top cover being configured to cover an upper face of the device body and to be loaded with the sheet with the image formed thereon, an operation panel provided at an upper front end side of the device body, the operation panel being configured to be inclined further down as going further toward a front end thereof, a grip portion provided in a region of the top cover adjacent to the operation panel, the grip portion being configured to be gripped by a user to hold the top cover, and an inclined surface provided at a front end side of the top cover, the inclined surface extending toward the operation panel so as to be inclined further down as going further toward a front end thereof.

In some aspects of the present invention, the operation panel is provided in an inclined state on the upper front end side of the device body. Therefore, the operation panel can comfortably be operated, and the user can easily open and close the top cover while gripping the grip portion.

Further, in some aspects, since the inclined surface is provided on the front end side of the top cover, it is possible to improve a flexural rigidity of the front end of the top cover including the grip portion. Thereby, it is possible to prevent the top cover from being deformed when the top cover is opened or closed with the grip portion being gripped by the user. Thus, in some aspects, such an improved configuration different from the known configuration can be provided.

According to aspects of the present invention, further provided is an image forming device configured to form an image on a sheet. The image forming device includes a device body, a side cover fixed to the device body to cover a side face of the device body, a top cover swingably attached to an upper rear end of the device body, the top cover being configured to cover an upper face of the device body and to be loaded with the sheet with the image formed thereon, the top cover and the side cover defining a mating portion as a boundary region therebetween, and an operation panel provided at an upper front end side of the device body, the operation panel being configured to be inclined further down as going further toward a front end thereof The side cover includes a plane portion, and an inclined portion formed in the mating portion, the inclined portion including a side cover inclined surface configured to be inclined with respect to the plane portion, the side cover inclined surface extending toward a back surface side of the top cover. The top cover includes a grip portion provided in a region of the top cover adjacent to the operation panel, the grip portion being configured to be gripped by a user to hold the top cover, and a top cover inclined surface provided at a front end side of the top cover, the top cover inclined surface extending toward the operation panel so as to be inclined further down as going further toward a front end thereof.

In some aspects of the present invention, the side cover inclined portion is provided at a side of the side cover in the mating portion. Therefore, the contour of the mating portion is obscurer than the known configuration without the side cover inclined portion. Accordingly, even though dimensions of the mating portion between the side cover and the top cover vary by relatively significant amounts, it is possible to prevent the image forming device from detracting from its appearance.

Further, in some aspects, the operation panel is provided in an inclined state on the upper front end side of the device body. Therefore, the operation panel can comfortably be operated, and the user can easily open and close the top cover while gripping the grip portion.

Further, in some aspects, since the top cover inclined surface is provided on the front end side of the top cover, it is possible to improve a flexural rigidity of the front end of the top cover including the grip portion. Thereby, it is possible to prevent the top cover from being deformed when the top cover is opened or closed with the grip portion being gripped by the user. Thus, in some aspects, such an improved configuration different from the known configuration can be provided.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, an embodiment according to aspects of the present invention will be described with reference to the accompany drawings. It is noted that, in the embodiment, aspects of the present invention are applied to an electrophotographic type image forming device.

1. General Overview of Image Forming Device

Figure 7:
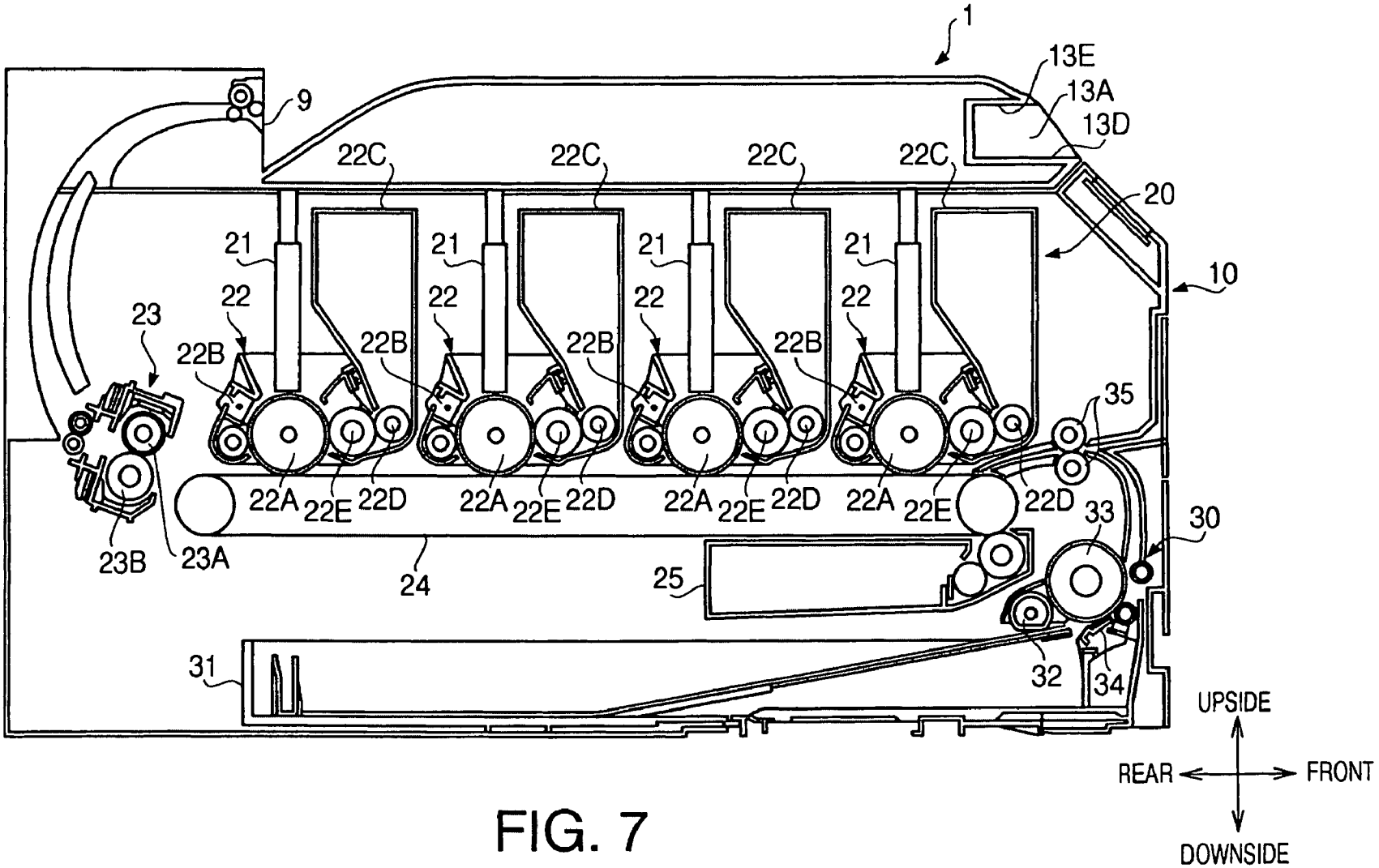
FIG. 7 is a cross-sectional side view of the image forming device in the embodiment according to one or more aspects of the present invention.

As illustrated in FIG. 7, a housing 10 of an image forming device 1 in the present embodiment incorporates therein an image forming unit 20 configured to form an image on a recording sheet (hereinafter referred to as a sheet) such as a paper and an OHP transparent sheet, and a feeder 30 configured to feed a sheet to the image forming unit 20. It is noted that FIG. 7 is a cross-sectional side view of the image forming device 1.

On an upper face side of the housing 10, a catch tray 11 is provided that is configured to be loaded with one or more sheet discharged from a discharge slot 9 after an image forming operation is completed. Further, the catch tray 11 is formed integrally on a top cover 13 (see FIG. 1) configured to cover an upper face of a device main body 50.

The image forming unit 20 is attached to a frame formed as a part of the device main body 50. The frame is configured with substantially plate-shaped side frames (not shown) disposed at both ends of the housing 10 in a right-to-left direction, a bottom plate (not shown) extending in the right-to-left direction to link lower end sides of the side frames, and a top plate linking upper end sides of the side frames.

1.1. Feeder

As shown in FIG. 7, the feeder 30 is configured with a sheet feed tray (sheet feed cassette) 31 detachably attached to a lowermost portion of the housing 10, a sheet feed roller (pickup roller) 32 that is provided at an upper front end of the sheet feed tray 31 and configured to feed a sheet to the image forming unit 20, and a separation roller 33 and a separation pad 34 that are configured to separate sheets fed by the sheet feed roller 32 on a sheet-by-sheet basis.

Further, a pair of registration rollers 35 disposed on an inlet side of the image forming unit 20 is configured to give a predetermined carrying resistance to a sheet being conveyed and perform skew correction for the sheet.

1.2. Image Forming Unit

The image forming unit 20 is configured to form a color image by superimposing, on a sheet, four sorts of developer images formed with four sorts of developers yellow, magenta, cyan, and black. Specifically, as illustrated in FIG. 7, the image forming unit 20 includes exposure units 21, developing units 22, and a fixing unit 23.

The exposure units 21 and the developing units 22 have four units each that corresponds to the four sorts of developers yellow, magenta, cyan, and black, respectively. Further, the exposure units 21, as well as the developing units 22, are arranged linearly along a sheet carrying direction Each of the exposure units 21 is configured to form an electrostatic latent image on a below-mentioned photoconductive drum 22A. Each of the exposure units 21 is attached to the top cover 13 and provided with LEDs that emit light for exposing a surface of the photoconductive drum 22A.

The developing units 22 and the photoconductive drums 22A are attached to the frame so as to be detachable from an opening 10 (see FIG. 6A) formed when the top cover 13 is swung and opened.

Each of the developing units 22 includes the photoconductive drum 22A configured to hold thereon a developer image to be transferred onto a sheet, a charger 22B configured to charge the surface of the photoconductive drum 22A, and a developer container 22C configured to store therein developer (powder toner in the present embodiment).

Between the developer container 22C and the photoconductive drum 22A, a supply roller 22D and a developing roller 22E are disposed, which are configured to supply developer from the developer container 22C to the photoconductive drum 22A.

The developer conveyed from the developer container 22C is supplied to the developing roller 22E owing to rotation of the supply roller 22D. Further, the developer supplied to the developing roller 22E is held on a surface of the developing roller 22E and thereafter supplied to the surface of the photoconductive drum 22A exposed by the exposure unit 21.

Additionally, in a position facing the photoconductive drum 22A via a sheet being conveyed, a transfer roller (not shown) is disposed, which is charged with electric charges (in the present embodiment, negative electric charges) of an opposite polarity to those on the photoconductive drum 22A. When the transfer roller is rotated in synchronization with the photoconductive drum 22A, the developer image formed on the surface of the photoconductive drum 22A is transferred onto a sheet.

The fixing unit 23 is configured to thermally fix the developer transferred onto the sheet. Specifically, the fixing unit 23 includes a heating roller 23A that is disposed on a printed surface side of the sheet and configured to heat the developer, and a pressing roller 23B that is disposed opposite the heating roller 23A via the sheet and configured to press the sheet toward the heating roller 23A.

A carrying belt is an endless belt for conveying the sheet. A belt cleaner 25 is configured to remove unnecessary developer adhered to the carrying belt 24.

2. External Shape of Image Forming Device

Figure 1:
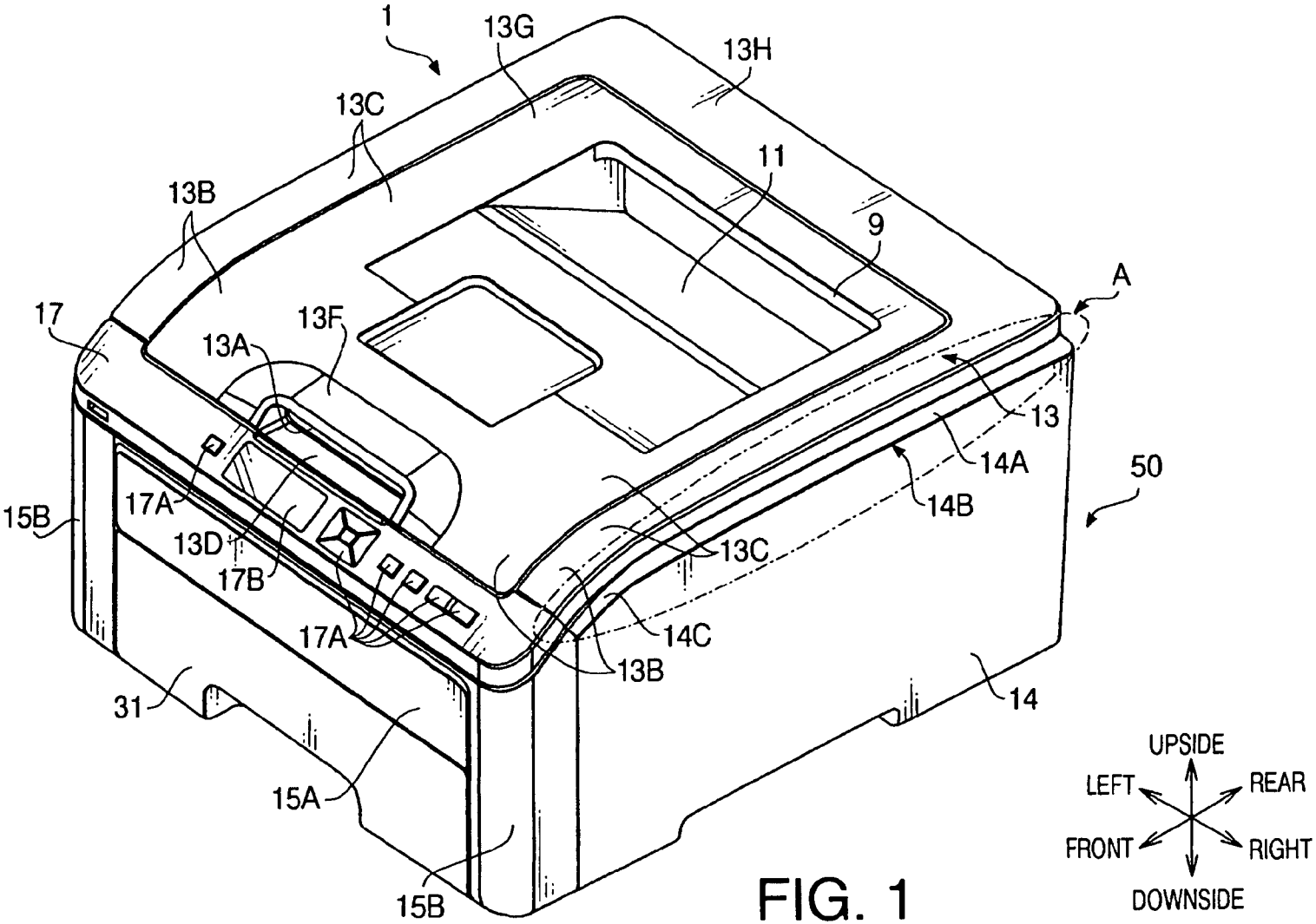
FIG. 1 is an external perspective view of an image forming device in an embodiment according to one or more aspects of the present invention.
Figure 2:
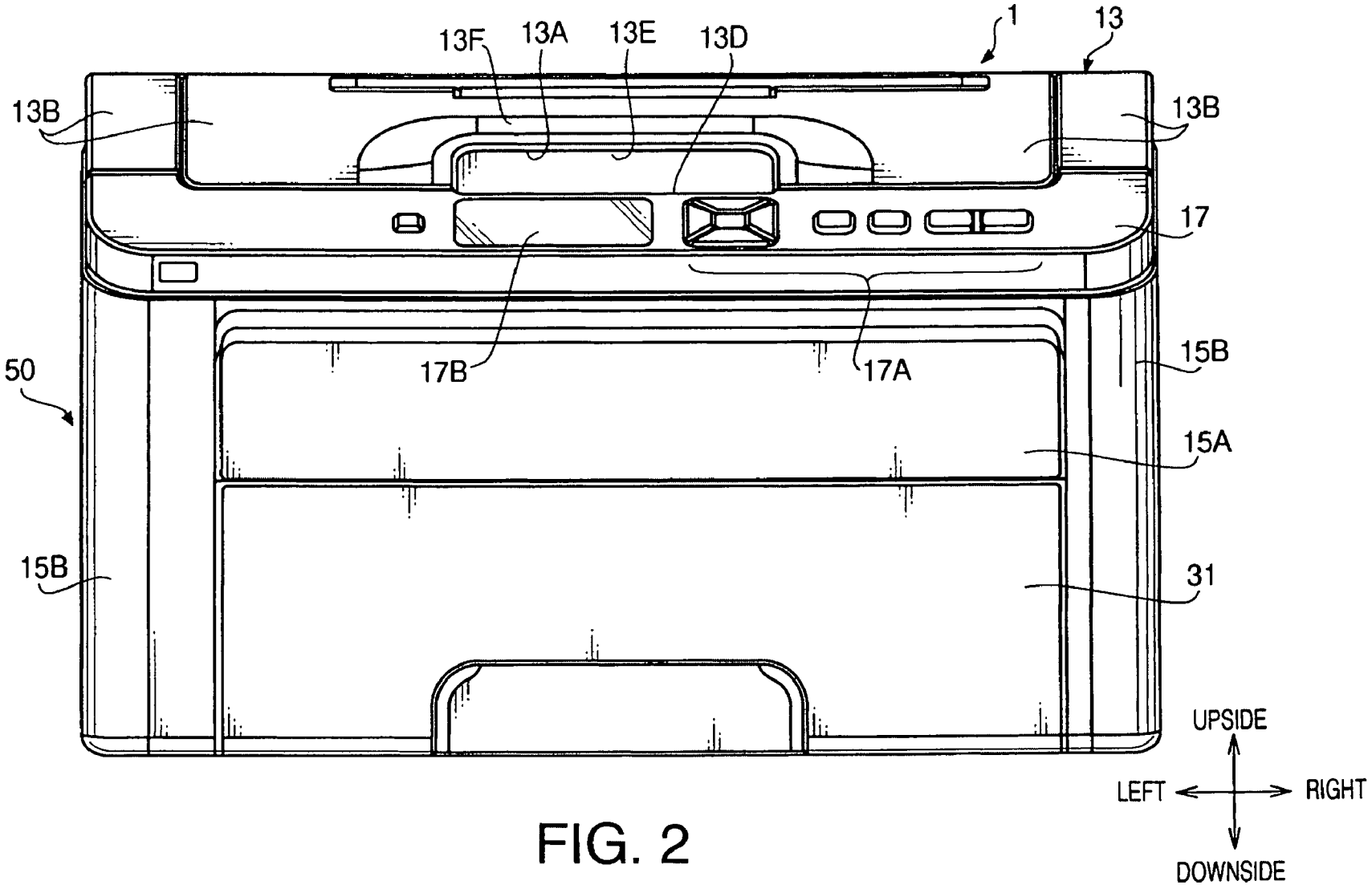
FIG. 2 is a front view of the image forming device in the embodiment according to one or more aspects of the present invention.
Figure 3:
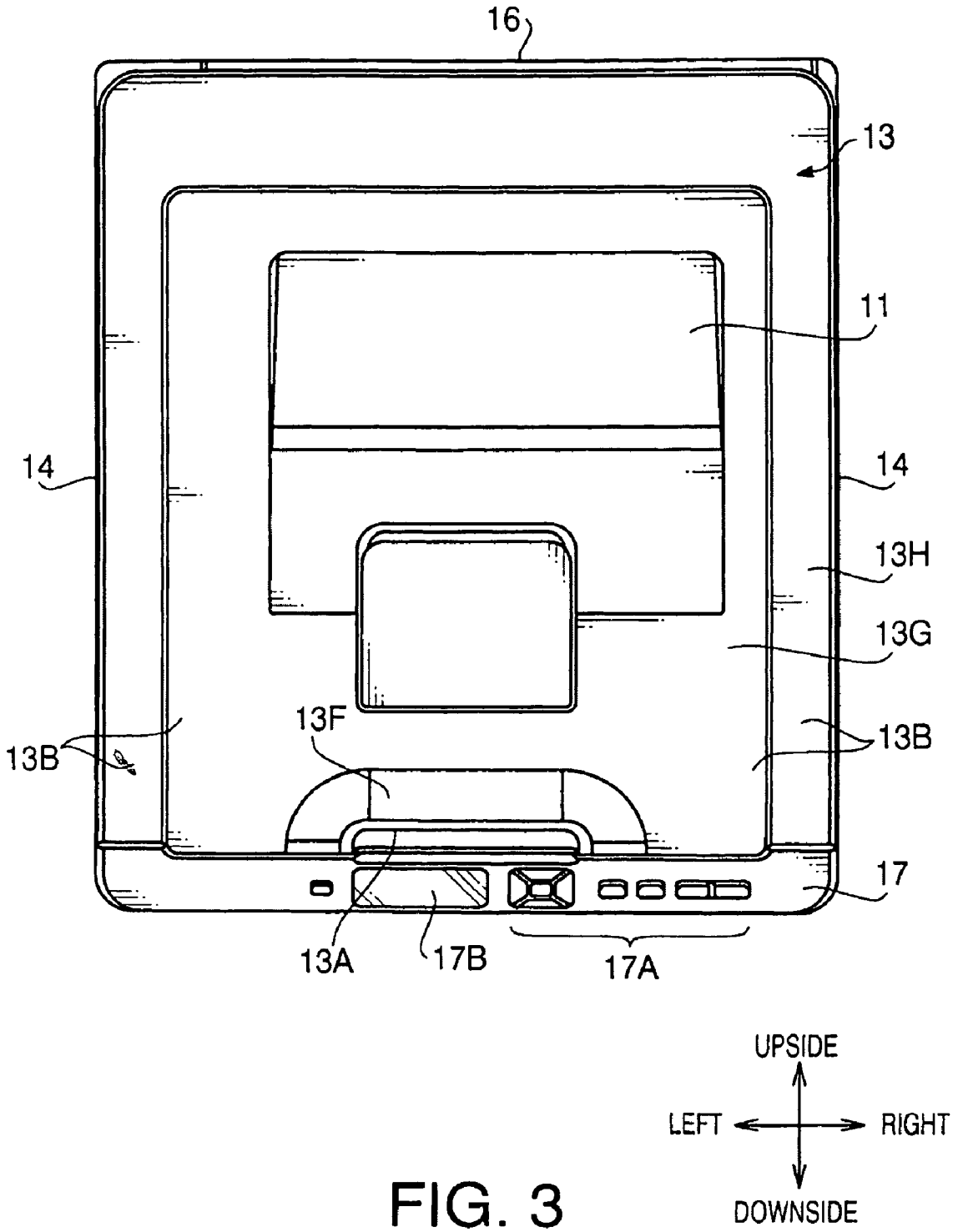
FIG. 3 is a top view of the image forming device in the embodiment according to one or more aspects of the present invention.

As illustrated in FIG. 1, the housing 10 of the image forming device 1 includes the top cover 13 configured to cover the upper face of the device main body 50, side covers 14 configured to cover side faces of the device main body 50, front covers 15A and 15B configured to cover a front face of the device main body 50, and a rear cover 16 (see FIG. 13) configured to cover a rear face of the device main body 50.

It is noted that the device main body 50 referred to here represents, as described above, a framework of the image forming device 1 that includes the frame. The top cover 13, the front cover 15A, and the rear cover 16 are attached swingably to the device main body 50 (frame), while the side covers 14 are fixed to the device main body 50 (frame).

Additionally, on an upper front end side of the device main body 50 (housing 10), an operation panel 17 is provided, which is configured as a surface inclined further down as going further to a front end side thereof.

The operation panel 17 is provided with a plurality of operation keys 17A to be operated by a user and a display unit 17B for displaying thereon various kinds of information. The display unit 17B is provided in a position on the operation panel 17 that corresponds to a below-mentioned grip portion 13A.

Incidentally, the display unit 17B is configured with a liquid crystal panel, and the operation panel 17 is so inclined that the user can visually recognize information displayed with ease. Further, on a front end side of the top cover 13, as illustrated in FIG. 1, a top cover inclined surface 13B is provided, which extends toward the operation panel 17 so as to be inclined further down as going further toward the front end side thereof. Additionally, the top cover inclined surface 13B is configured with a curved surface into which a horizontal surface 13C of the top cover 13 continues.

In a position adjacent to the operation panel 17 on the top cover inclined surface 13B, the grip portion 13A is provided to allow the user to hold the top cover 13 and configured with an opening provided substantially at a center of the top cover inclined surface 13B in the right-to-left direction. The grip portion 13A is gripped, for instance, when the top cover 13 is swung and opened (closed).

Figure 9:
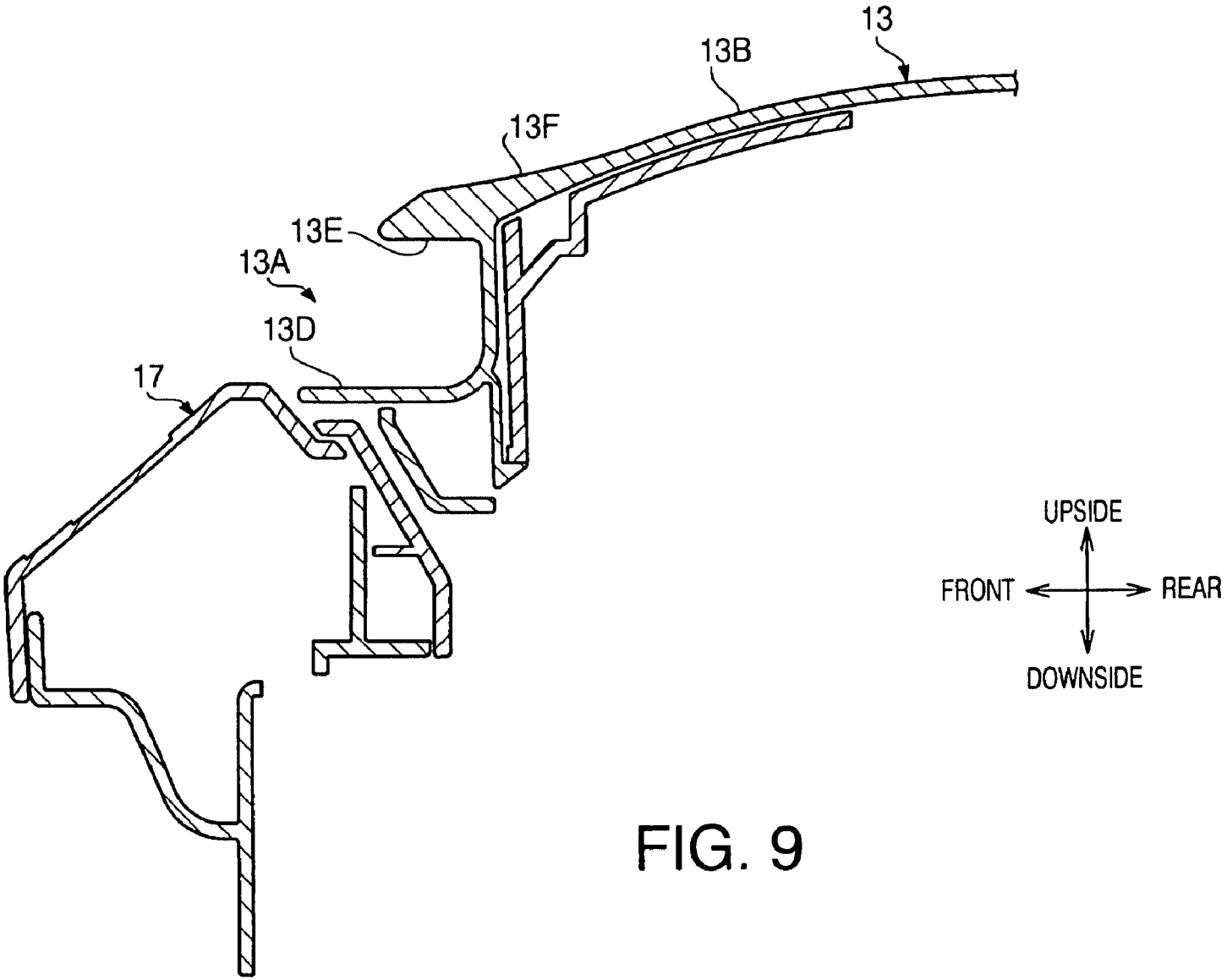
FIG. 9 is a cross-sectional side view showing a grip portion provided to the top cover in the embodiment according to one or more aspects of the present invention.

As shown in FIG. 9, the opening of the grip portion 13A is configured as a recess fallen inward (toward a rear side) with a lower inner wall surface 13D and an upper inner wall surface 13E. The top cover inclined surface 13B includes a gently inclined surface 13F provided above the grip portion 13A. The gently inclined surface 13F is inclined at a smaller tilt angle with respect to a horizontal direction than any other regions of the top cover inclined surface 13B.

Figure 8:
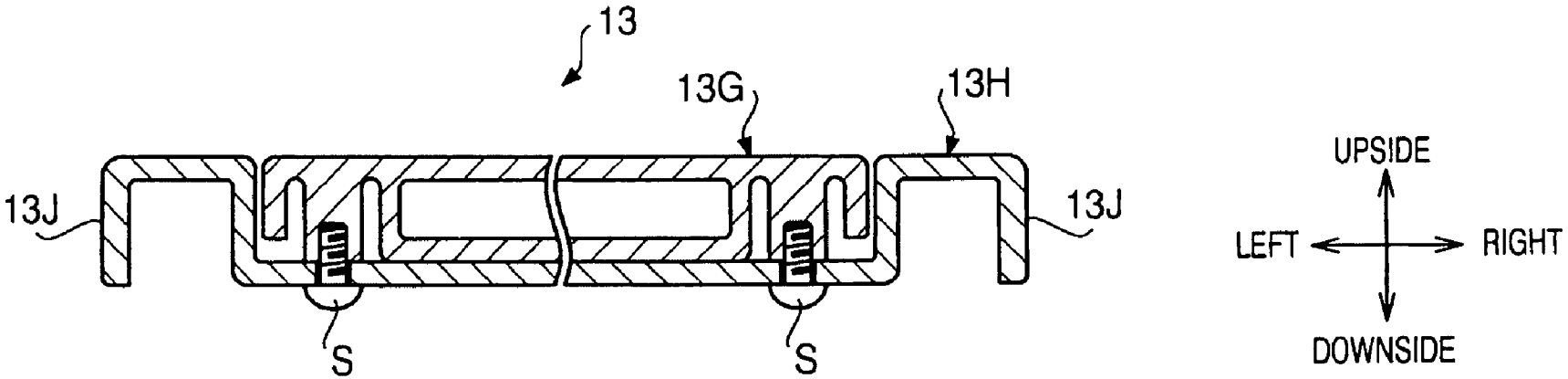
FIG. 8 is a cross-sectional view of the top cover along a right-to-left direction in the embodiment according to one or more aspects of the present invention.

As shown in FIG. 1, the top cover 13 of the present embodiment is configured with a rectangular resin portion 13G provided with the grip portion 13A and the catch tray 11 and a substantially U-shaped resin frame portion 13H formed to surround the rectangular portion 13G. As illustrated in FIG. 8, the rectangular portion 13G and the frame portion 13H are integrated by using mechanically fastening members such as screws S.

A cross-sectional shape of the frame 13H is formed in a rectangular wave shape to have side wall portions 13J, provided at both ends of the top cover 13 in the right-to-left direction, which extend toward the side covers 14, respectively. On the other hand, a cross-sectional shape of the rectangular portion 13G is formed to have wall portions (ribs) parallel to the side wall portions.

Figure 10A:
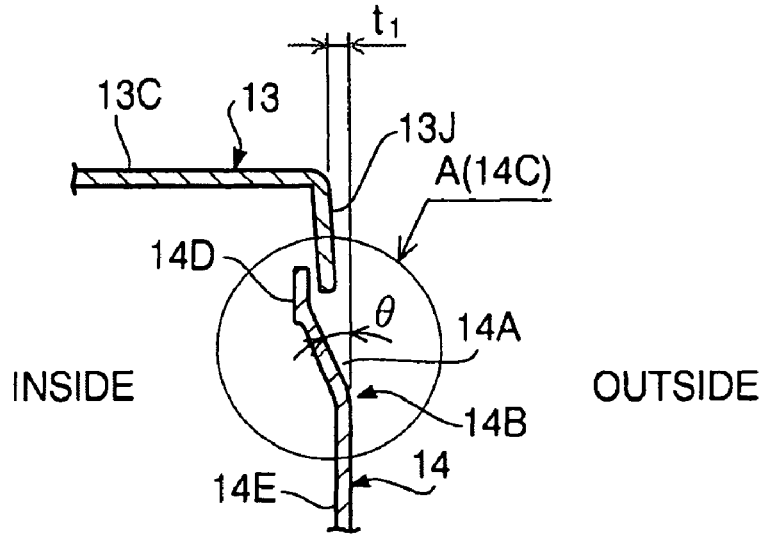
FIG. 10A is a cross-sectional side view along an A-A line shown in FIG. 6 in the embodiment according to one or more aspects of the present invention.

Additionally, as illustrated in FIG. 10A, either one cover (in the present embodiment, the side cover 14) in a mating portion (portion A in FIG. 1) between the side cover 14 and the top cover 13 includes an inclined portion 14B that has a side cover inclined surface 14A. The side cover inclined surface 14A extends toward a back surface side of the other cover (in the present embodiment, the top cover 13), and is tilted with respect to the horizontal surface 13C of the top cover 13.

Specifically, in the present embodiment, as shown in FIG. 10A, an upper end side of the side cover 14 in the mating portion includes the side cover inclined surface 14A that is tilted inward with respect to a vertical direction and extends toward a back surface side of the side wall portion 13J. Further, at a distal end of the side cover inclined surface 14A in an extending direction, a facing portion 14D is provided to face the back surface (inner surface) of the side wall portion 13J of the top cover 13 and extend upward in the vertical direction.

The mating portion between the side cover 14 and the top cover 13 represents end portions adjacent to one another of both the covers 13 and 14. Further, the mating portion partially forms a contour of the image forming device 1, and specifically is the portion A shown in FIG. 1.

Figure 4:
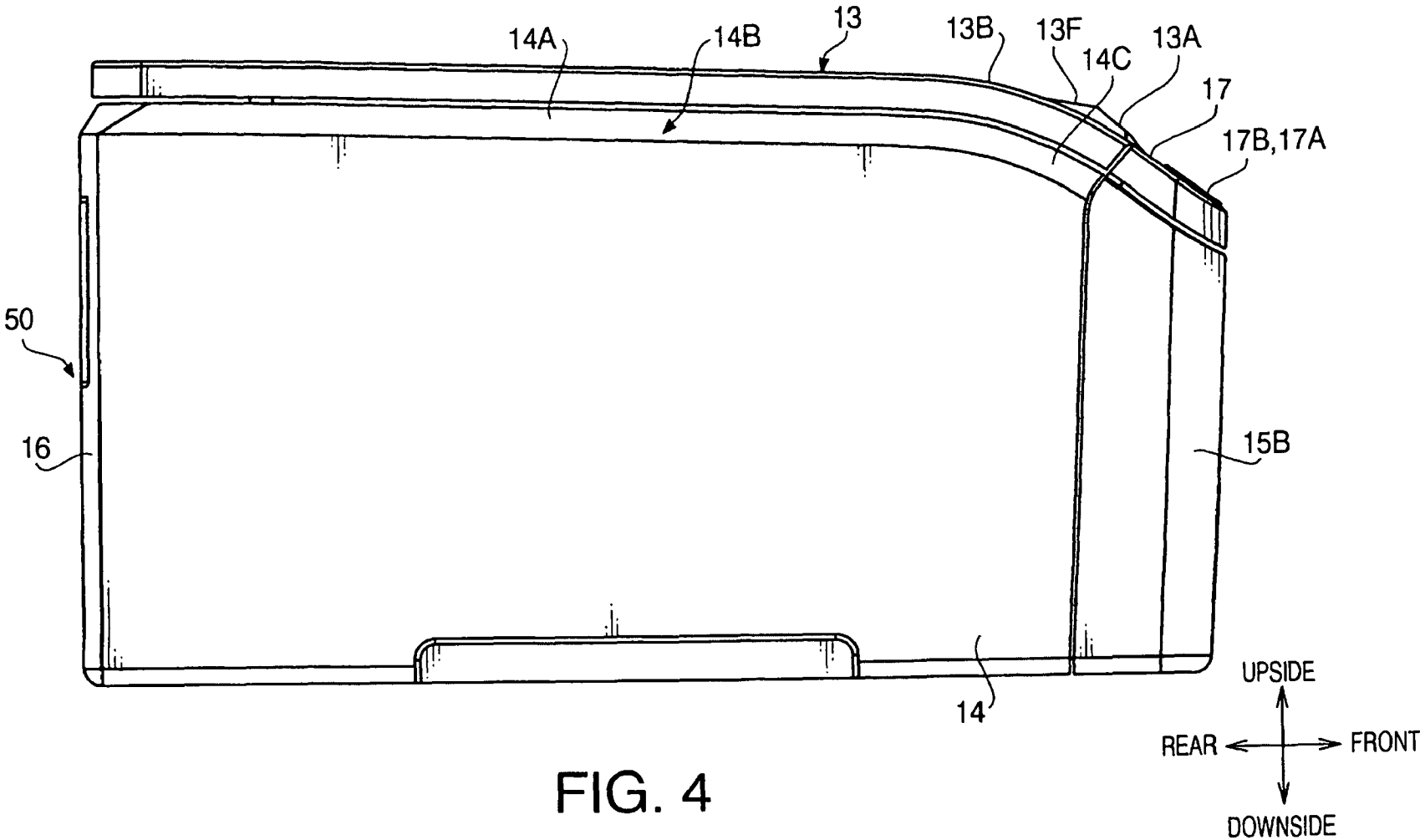
FIG. 4 is a left side view of the image forming device in the embodiment according to one or more aspects of the present invention.
Figure 5:
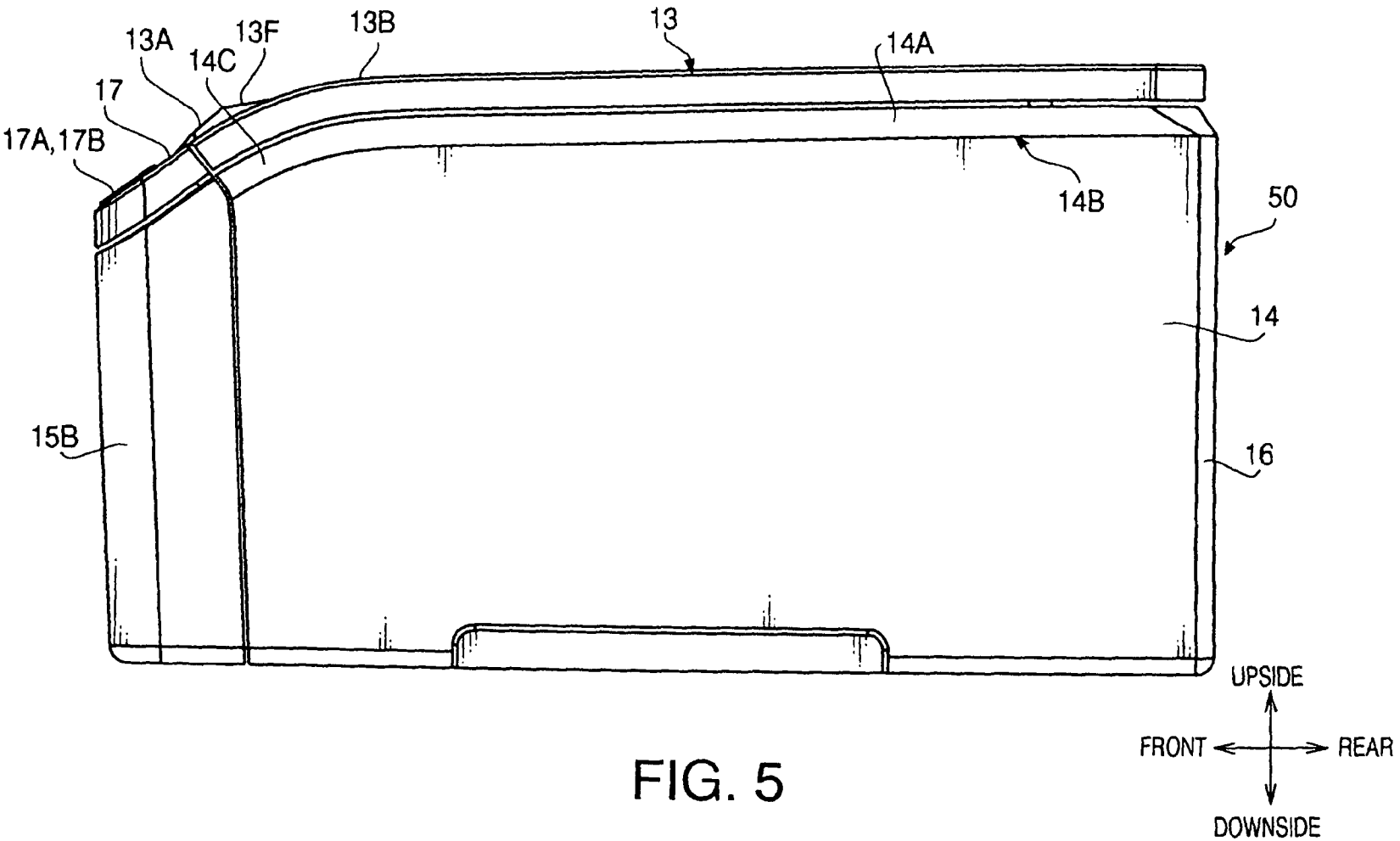
FIG. 5 is a right side view of the image forming device in the embodiment according to one or more aspects of the present invention.
Figure 10B:
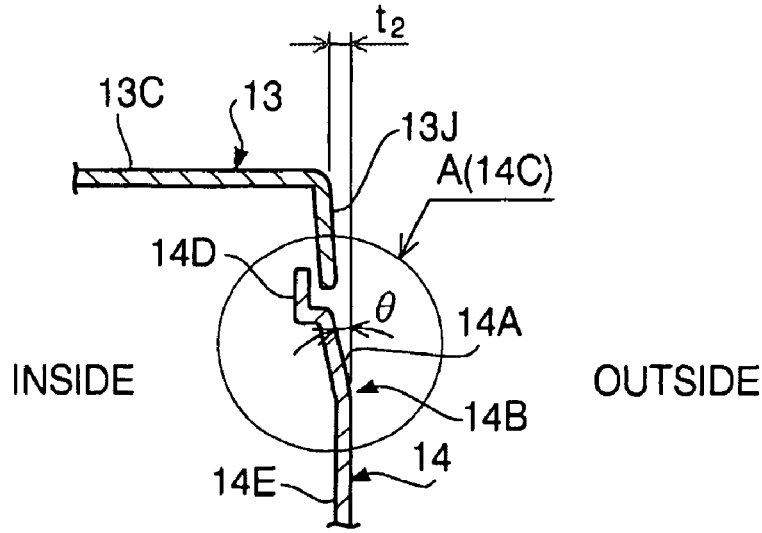
FIG. 10B is a cross-sectional side view along a B-B line shown in FIG. 6 in the embodiment according to one or more aspects of the present invention.
Figure 10C:
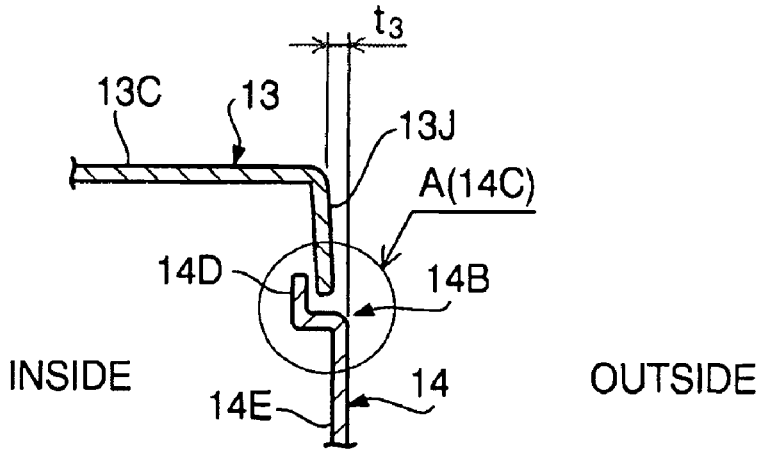
FIG. 10C is a cross-sectional side view along a C-C line shown in FIG. 6 in the embodiment according to one or more aspects of the present invention.

As illustrated in FIGS. 1, 4, and 5, the inclined portion 14B extends, in a belt shape, from a rear end to a front end of each side face of the image forming device 1. As shown in FIGS. 10A to 10C, the inclined portion 14B includes a twisted surface 14C at a front end thereof that is formed with a smaller tilt angle with respect to the vertical direction as going further to a front end thereof.

Specifically, at the front end of the inclined portion 14B, as shown in FIG. 10C, the inclined portion 14B is hardly formed, and a cross section thereof is formed in a crank shape. As going further from the front end to the rear end, as illustrated in FIGS. 10B and 10A in the above cited order of the figures, the side cover inclined surface 14A is formed with a greater tilt angle θ with respect to the vertical direction. In a region of the side cover inclined surface 14A that corresponds to the horizontal surface 13C of the top cover 13, the tilt angle θ of the side cover inclined surface 14A is substantially constant.

In other words, in a region that continues from the rear end of the inclined portion 14B and corresponds to the horizontal surface 13C of the top cover 13, as shown in FIG. 1, the side cover inclined surface 14A is provided with a constant tilt angle θ. Further, in a region corresponding to the top cover inclined surface 13B, the twisted surface 14C is provided which has a smaller tilt angle with respect to the vertical direction as going further to the front end thereof.

In the present embodiment, the side cover inclined surface 14A and the twisted surface 14C are integrally formed when the side cover 14 is formed. Further, even though a plane portion 14E of the side cover 14 parallel to the vertical direction is shifted from an ideal position (design position) thereof by a maximum amount within a tolerance, as shown in FIGS. 1A to 10C, the plane portion 14E is designed to be located outside the side wall portion 13J in the right-to-left direction. Namely, in the present embodiment, the plane portion 14E of the side cover 14 jetties outside the side wall portion 13J of the top cover 13 when viewed from an upside thereof.

Further, in the present embodiment, a gap t between the plane portion 14E and the side wall portion 13J in the right-to-left direction is constant even at the twisted surface 14C (i.e., $t1=t2=t3$). However, aspects of the present invention are not limited to such a configuration in the present embodiment.

The mating portion (portion A in FIG. 1) may be designed to have a smaller gap t as going further to the front end thereof (i.e., t1>t2>t3).

3. Features of Image Forming Device

When dimensions of the mating portion between the side cover 14 and the top cover 13 vary by relatively significant amounts due to manufacturing dimensional errors of the side cover 14 and the top cover 13 and/or assembly errors of the side cover 14 and the top cover 13, the image forming device 1 might detract from its appearance.

In this regard, in the present embodiment, the side cover 14 includes the inclined portion 14B provided at the mating portion. Therefore, the contour of the side cover 14 in the present embodiment is obscurer than a configuration without the inclined portion 14B. Accordingly, even though the dimensions of the mating portion between the side cover 14 and the top cover 13 vary by relatively significant amounts, it is possible to prevent the image forming device 1 from detracting from its appearance.

Additionally, since the plane portion 14E of the side cover 14 is located outside the side wall portion 13J of the top cover 13, it is possible to avoid an end portion of the top cover 13 protruding outward from the side cover 14. Thus, it is possible to prevent the image forming device 1 from detracting from its appearance.

Further, in the present embodiment, the operation panel 17 is provided in an inclined state on the front end side of the device main body 50. Therefore, the operation panel 17 can comfortably be operated, and the user can easily open and close the top cover 13 while gripping the grip portion 13A.

Further, since the top cover inclined surface 13B is provided on the front end side of the top cover 13, it is possible to improve a flexural rigidity of the front end of the top cover 13, namely, a flexural rigidity of a portion including the grip portion 13A. Thus, it is possible to prevent the top cover 13 from being deformed.

Figure 6:
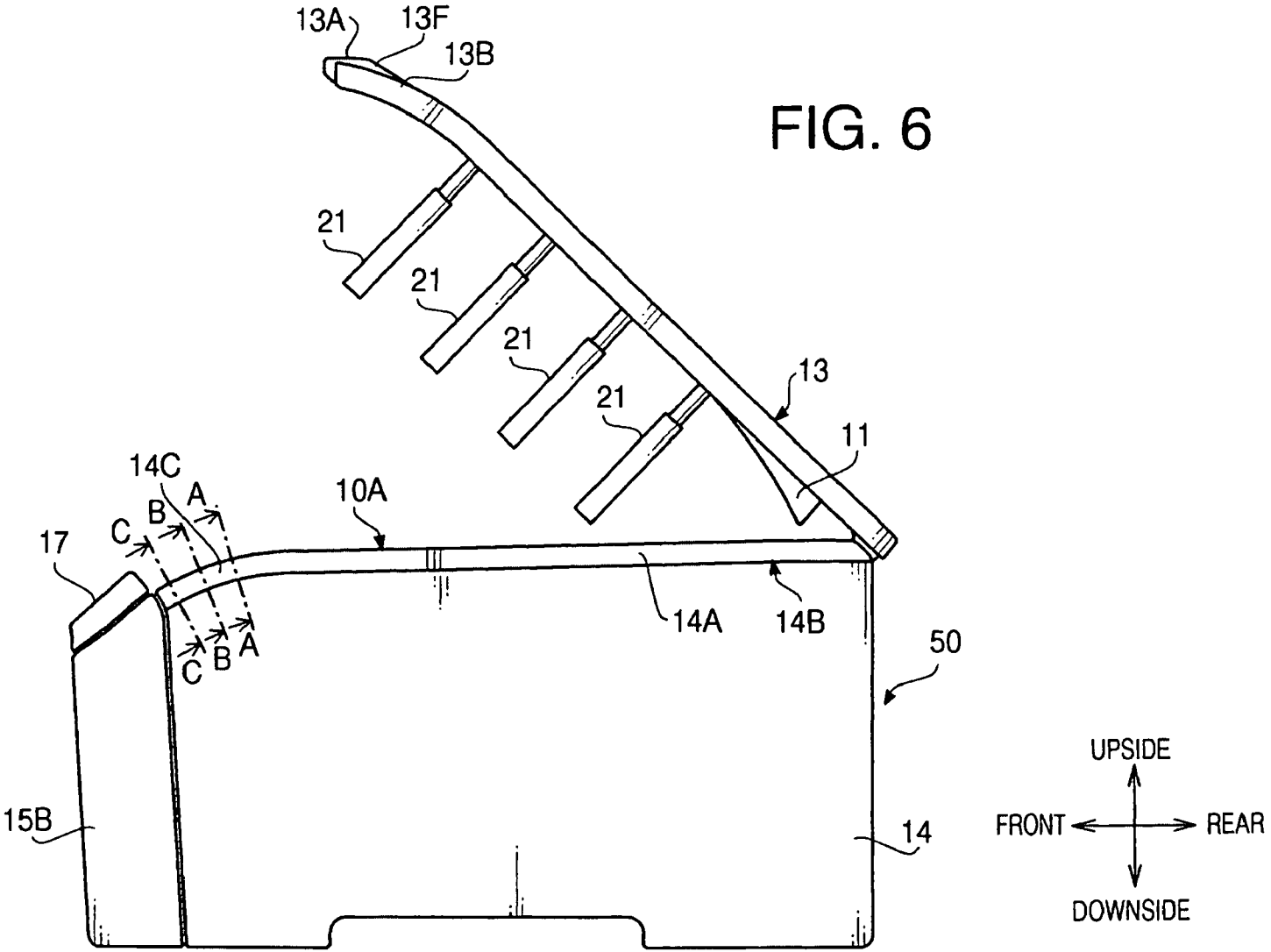
FIG. 6 is a right side view of the image forming device when a top cover thereof is opened in the embodiment according to one or more aspects of the present invention.

Additionally, in the image forming device 1 of the present embodiment, as illustrated in FIG. 6, the exposure units 21 are attached to the top cover 13. Hence, when a stiffness of the top cover 13 is not enough, a position of each exposure unit 21 with respect to a corresponding photoconductive drum 22A might be shifted.

However, as described above, in the present embodiment, the top cover 13 with an improved stiffness can avoid an undesired displacement between the exposure unit 21 and the photoconductive drum 22A.

Further, in the present embodiment, the grip portion 13A is provided substantially at the center of the top cover inclined surface 13B in the right-to-left direction. Therefore, the top cover 13 is harder to deform when it is opened or closed than a top cover configured with the grip portion 13*a* provided off the center of the top cover inclined surface 13B.

Further, in the present embodiment, the opening of the grip portion 13A is configured as a recess fallen inward with the lower inner wall surface 13D and the upper inner wall surface 13E. Thus, it is possible to prevent a hand (finger) of the user from reaching an inside of the device main body 50 through the opening of the grip portion 13A.

In the meantime, a sheet discharged onto the top cover 13 is placed on the top cover 13 of which the front end side is inclined down in a direction toward the front end. Therefore, the sheet placed on the top cover 13 might slip forward and fall down from the top cover 13.

In this regard, in the present embodiment, above the grip portion 13A, the gently inclined surface 13F is provided, which is inclined at a smaller tilt angle with respect to the horizontal direction than other portions on the top cover inclined surface 13B. Hence, it is possible to prevent the sheet placed on the top cover 13 from falling down from the top cover 13.

In the meantime, the operation panel 17 includes the operation keys 17A to be operated by the user. Therefore, when the user tries to grip the grip portion 13A, the user might mistakenly touch one or more operation keys and cause a wrong operation of the image forming device 1.

In this regard, in the present embodiment, the display unit 17B displaying information thereon is provided in a region on the operation panel 17 in front of the grip portion 13A. The operation keys 17A are never provided at least in the region on the operation panel 17 where the display unit 17B is provided.

Since the display unit 17B is dedicated to displaying information, there is no problem even though the user mistakenly touches the display unit 17B. Therefore, in the present embodiment, it is possible to reduce wrongly caused operations of the image forming device 1.

Further, in the present embodiment, the gap t is provided between the plane portion 14E and the side wall portion 13J in the right-to-left direction. Therefore, even though the image forming device 1 is installed to place one of the side covers 14 thereof along a wall in a room, it is possible to prevent the top cover 13 from interfering with the wall when the top cover 13 is opened or closed.

Further, the top cover 13 is provided with the exposure units 21 included in the image forming unit 20. When the top cover 13 interferes and comes into contact with the wall in the room, one or more exposure units 21 might be damaged and/or the positions thereof might be shifted due to a shock of the contact. Then, it might cause formation of an image of low quality.

However, in the image forming device 1 of the present embodiment, the aforementioned gap t is provided, and therefore the above problem can be avoided.

Hereinabove, the embodiments according to aspects of the present invention have been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only exemplary embodiments of the present invention and but a few examples of its versatility are shown and described in the present disclosure. It is to be understood that the present invention is capable of use in various other combinations and environments and is capable of changes or modifications within the scope of the inventive concept as expressed herein.

(Modifications)

In the aforementioned embodiment, the top cover inclined surface 13B is provided to the top cover 13. However, aspects of the present invention are not limited to such a configuration. For example, the image forming device 1 may be configured without the top cover inclined surface 13B.

Further, in the aforementioned embodiment, the grip portion 13A is provided at the top cover inclined surface 13B. However, aspects of the present invention are not limited to such a configuration. For example, the grip portion 13A may be provided in a region of the top cover 13 image forming device 1 other than the top cover inclined surface 13B.

Further, in the aforementioned embodiment, the grip portion 13A is provided at the center of the front end of the top cover 13. However, aspects of the present invention are not limited to such a configuration. For example, the grip portion 13A may be provided off the center of the front end of the top cover 13.

Further, in the aforementioned embodiment, the gently inclined surface 13F is provided above the grip portion 13A. However, aspects of the present invention are not limited to such a configuration. For example, the top cover 13 may be configured without the gently inclined surface 13F.

Further, in the aforementioned embodiment, the grip portion 13A is configured as a recess fallen inward. However, aspects of the present invention are not limited to such a configuration. For example, the grip portion 1 3A may be configured as a protrusion provided on the top cover 13.

Further, in the aforementioned embodiment, the inclined portion 14B is provided to the side cover 14. However, aspects of the present invention are not limited to such a configuration. For example, the inclined portion 14B may be provided to the top cover 13.

Further, in the aforementioned embodiment, the inclined portion 14B is configured with the twisted surface 14C provided at the front end thereof. However, aspects of the present invention are not limited to such a configuration. For example, the inclined portion 14B may be configured without the twisted surface 14C.

Further, in the aforementioned embodiment, the plane portion 14E is configured to be located outside the side wall portion 13J in the right-to-left direction. However, aspects of the present invention are not limited to such a configuration.

Further, in the aforementioned embodiment, the LED is employed for the exposure units 21. However, aspects of the present invention are not limited to such a configuration. For example, each exposure unit 21 may be configured with a scanner that scans laser light.

Further, in the aforementioned embodiment, the present invention is applied to a color electrophotographic type image forming device. However, for instance, the present invention may be applied to other types of image forming devices such as an inkjet type image forming device.

What is claimed is:

1. An image forming device, comprising:

a device body;

a side cover fixed to the device body to cover a side face of the device body;

a top cover attached swingably to the device body to cover an upper face of the device body, the top cover and the side cover defining a mating portion as a boundary region therebetween;

a plane portion formed in the side cover; and an inclined portion formed in the side cover in the mating portion, the inclined portion including an inclined surface configured to be inclined with respect to the plane portion, the inclined surface extending toward a back surface side of the top cover, and a twisted surface formed on the plane portion at one end of the inclined portion in the longitudinal direction thereof next to the inclined surface.

2. The image forming device according to claim 1, wherein the plane portion is substantially parallel to a vertical direction, and wherein the inclined surface is inclined with respect to the vertical direction.

3. The image forming device according to claim 2, wherein the top cover includes a side wall portion extending toward the side cover, and wherein the plane portion of the side cover is located outside the side wall portion of the top cover in a first horizontal direction substantially perpendicular to the plane portion.

4. The image forming device according to claim 3, wherein the inclined portion extends in a belt shape substantially in a second horizontal direction, as a longitudinal direction thereof, parallel to the plane portion, and wherein the twisted surface is formed with a smaller tilt angle with respect to the vertical direction in a direction toward the one end.

5. The image forming device according to claim 4, wherein the inclined portion includes a facing portion configured to face an inner surface of the side wall portion of the top cover and extend from the inclined surface upward in the vertical direction.

6. The image forming device according to claim 1, wherein a front end of the inclined surface is inclined to a small degree such that a cross section of the inclined surface is formed in a crank shape.

7. The image forming device according to claim 1, wherein the top cover includes a top cover inclined surface inclined toward a front end side of the image forming device, the top cover inclined surface having a leading end which is inclined from a side view of the image forming device.

8. An image forming device configured to form an image on a sheet, comprising:

a device body;

a top cover swingably attached to an upper rear end of the device body, the top cover being configured to cover an upper face of the device body and to be loaded with the sheet with the image formed thereon;

an operation panel provided at an upper front end side of the device body, the operation panel being configured to be inclined in a downward direction toward a front end thereof;

a grip portion provided at a front end of the top cover adjacent to the operation panel with an opening forming a recess toward a rear end side of the top cover, the grip portion being configured to be gripped by a user to hold the top cover; and an inclined surface provided at a front end side of the top cover, the inclined surface extending toward the operation panel so as to be inclined in a downward direction toward a front end thereof.

9. The image forming device according to claim 8, wherein the opening is provided substantially at a center of the inclined surface in a horizontal direction perpendicular to a front-to-rear direction of the device body.

10. The image forming device according to claim 9, wherein the recess is fallen inward with a lower inner wall surface and an upper inner wall surface.

11. The image forming device according to claim 9, wherein the inclined surface includes an inclined surface provided above the grip portion, the inclined surface being inclined at a smaller tilt angle with respect to a horizontal direction than any other regions of the inclined surface.

12. The image forming device according to claim 8, wherein the operation panel includes a display unit provided in a region on the operation panel in front of the grip portion, the display unit configured to display thereon information.

13. The image forming device according to claim 8, further comprising a horizontal surface provided on the top cover, wherein the inclined surface includes a curved surface into which the horizontal surface continues.

14. An image forming device configured to form an image on a sheet, comprising:

a device body;

a side cover fixed to the device body to cover a side face of the device body;

a top cover swingably attached to an upper rear end of the device body, the top cover being configured to cover an upper face of the device body and to be loaded with the sheet with the image formed thereon, the top cover and the side cover defining a mating portion as a boundary region therebetween; and an operation panel provided at an upper front end side of the device body, the operation panel being configured to be in a downward direction toward a front end thereof, wherein the side cover includes:

a plane portion; and an inclined portion formed in the mating portion, the inclined portion including a side cover inclined surface configured to be inclined with respect to the plane portion, the side cover inclined surface extending toward a back surface side of the top cover, and a twisted surface formed on the plane portion at one end of the inclined portion in the longitudinal direction thereof next to the side cover inclined surface, and wherein the top cover includes:

a grip portion provided at a front end of the top cover adjacent to the operation panel with an opening forming a recess toward a rear end side of the top cover, the grip portion being configured to be gripped by a user to hold the top cover; and a top cover inclined surface provided at a front end side of the top cover, the top cover inclined surface extending toward the operation panel so as to be inclined in a downward direction toward a front end thereof.

* * * * *